United States Patent [19]

Manabe et al.

[11] 4,338,209

[45] Jul. 6, 1982

[54] METAL CORROSION INHIBITOR

[75] Inventors: Isao Manabe; Akiyoshi Inubushi, both of Tokushima, Japan

[73] Assignee: Otsuka Chemical Co., Ltd., Osaka, Japan

[21] Appl. No.: 135,451

[22] Filed: Mar. 31, 1980

Related U.S. Application Data

[63] Continuation of Ser. No. 943,968, Sep. 20, 1978, abandoned.

[30] Foreign Application Priority Data

Oct. 1, 1977 [JP] Japan ..... 52-118368

[51] Int. Cl.[3] ..... C09K 5/00; C23F 11/18

[52] U.S. Cl. ..... 252/75; 252/76; 252/77; 252/78.1; 252/79; 252/389 A; 252/391; 252/392

[58] Field of Search ..... 252/68, 71, 75, 76–78.1, 252/143, 150, 389 A, 391, 79, 392

[56] References Cited

U.S. PATENT DOCUMENTS

| | | | |
|---|---|---|---|
| 2,054,282 | 9/1936 | Clarkson et al. | 252/75 |
| 2,426,496 | 8/1947 | Farley | 252/395 |
| 2,739,871 | 3/1956 | Senkus | 252/390 X |
| 3,240,708 | 3/1966 | Dulat et al. | 252/76 |
| 3,291,741 | 12/1966 | Monroe et al. | 252/76 |
| 3,414,519 | 12/1968 | Beynon | 252/75 |
| 3,425,954 | 2/1969 | Ruzevick et al. | 252/392 |
| 3,769,220 | 10/1973 | Willard et al. | 252/75 |
| 3,876,553 | 4/1975 | Kader | 252/389 A |
| 4,160,740 | 7/1979 | Sweet | 252/75 |

FOREIGN PATENT DOCUMENTS

| | | |
|---|---|---|
| 232402 | 2/1961 | Australia . |
| 573227 | 3/1959 | Canada . |
| 624410 | 7/1961 | Canada . |
| 1201121 | 2/1964 | Fed. Rep. of Germany . |
| 51-13338 | 2/1976 | Japan . |
| 52-76241 | 6/1977 | Japan . |
| 6810768 | 2/1970 | Netherlands . |
| 945638 | 1/1964 | United Kingdom . |
| 1013707 | 12/1965 | United Kingdom . |
| 1210370 | 10/1970 | United Kingdom . |

OTHER PUBLICATIONS

"British Standard Specification for Corrosion-Inhibited Ethanediol Antifreeze for Water-Cooled Engines", British Standards Institution, B.S. 3151:1959.

*Primary Examiner*—P. E. Willis, Jr.
*Attorney, Agent, or Firm*—Armstrong, Nikaido, Marmelstein & Kubovcik

[57] ABSTRACT

Metal corrosion inhibitor comprising (a) benzoic acid and/or a benzoate, (b) nitrous acid and/or a nitrite, (c) phosphoric acid and/or a phosphate, and (d) at least one selected from mercaptobenzothiazole, its salts, benzotriazole and tolyltriazole, which can exhibit excellent anti-corrosive property to various metals for a long term and can be diluted with an aqueous liquor and can be employed in combination with usual anti-freezing agents.

3 Claims, No Drawings

METAL CORROSION INHIBITOR

This is a continuation of application Ser. No. 943,968, filed Sept. 20, 1978, now abandoned.

The present invention relates to a novel metal corrosion inhibitor, and more particularly to a corrosion inhibitor for various metals such as aluminum, cast aluminum, cast iron, steel, brass, copper and solder, which can exhibit the sufficient anti-corrosive property for a long term and can be diluted with an aqueous liquor and can be employed in combination with a usual anti-freezing agent.

Water is usually employed as a heat medium for cooling of an internal-combustion engine, and in order to prevent the freezing of cooling water in winter, there are suitably employed anti-freezing agents which depress the freezing point of water. In general, alcohols miscible with water such as lower alcohols and glycols are employed as anti-freezing agents. However, such anti-freezing agents have the disadvantage that they are oxidized to acidic materials by contact with air at high temperatures and corrode a metal of a cooling system. The corroded metal adheres to a heat exchanger to lower the thermal conductivity and to cause choking of capillary portions, by which the so-called overheating phenomenon occurs. Also, when the corrosion of metal further proceeds to a high degree, the cooling water leaks.

In order to eliminate this disadvantage, various metal corrosion inhibitors are added to the anti-freezing agents. Although many reports concerning the addition of the metal corrosion inhibitors to the anti-freezing agents have been presented, satisfactory metal corrosion inhibitor has not been proposed, since while various metals such as aluminum, cast aluminum, cast iron, steel, brass, copper and solders are suitably employed in combination in cooling systems of recent internal-combustion engines and other apparatuses, the kinds of the metals to which known metal corrosion inhibitors are applicable are limited. For instance, a metal corrosion inhibitor consisting of triethanolamine, a phosphate and a sodium salt of mercaptobenzothiazole according to British Standards 3150 is not sufficiently effective to prevent corrosion of cast iron, steel and cast aluminum, and also a metal corrosion inhibitor consisting of sodium benzoate and sodium nitrite according to British Standards 3151 is not sufficiently effective to prevent corrosion of copper, brass and cast aluminum. British Patent No. 10137073 discloses a metal corrosion inhibitor consisting of sodium benzoate, sodium nitrite and a phosphate, but its anti-corrosive effect is insufficient for any of the above-mentioned metals and particularly the anti-corrosive effect to brass is very poor. Thus, these corrosion inhibitors can not exhibit sufficient effect to all of the various metals employed in cooling systems.

When many kinds of metals are employed in combination, Galvanic cell is formed between different metals and corrosion is accelerated. In recent years, it is required to make vehicles lightweight with the speed-up of the vehicles, and for the purpose, cast aluminum articles are frequently employed especially for parts of engines. The cast aluminum articles are poor in corrosion resistance, and particularly have the disadvantage that local corrosion is easy to occur, since Galvanic cell is formed between the cast aluminum and steel which is a main constituent material of the cooling system. Moreover, since the corrosion of aluminum or cast aluminum is generally pitting, very deep corrosion occurs in part, despite that the degree of corrosion is not so large, and finally passes through and cooling water leaks out. This is a fatal defect of whole cooling system.

Also, in recent years, there are put on the market various anti-freezing agents having anti-corrosive property, for instance, commercially available under the commercial name of "Long Life Coolant". As a means of judging the life of the anti-corrosive property, metal corrosion testing methods provided, for instance, in Japanese Industrial Standards (hereinafter referred to as JIS) K 2234 and ASTM D 1384-65 are adopted at present, but a period of testing is 14 days in both methods and such a short period is insufficient for the judgement of the anti-corrosive property. When tested for a long term, for instance, for 90 days or 120 days, commercially available metal corrosion inhibitors and anti-freezing agents containing such corrosion inhibitors cause the change in pH and the deterioration of reserve alkalinity and have the disadvantage that the anti-corrosive property remarkably lowers during the use for a long term. Particularly, the life of the anti-freezing agents containing metal corrosion inhibitors is very short, since the anti-freezing agents are oxidized to acidic materials.

The corrosion of metals is also caused by corrosive ions such as chlorine ion, sulfate ion and carbonate ion and dissolved gases such as oxygen, which are usually contained in water, in addition to oxidation products of the alcohols employed as anti-freezing agents. Therefore, it is necessary to add metal corrosion inhibitors to cooling water also in summer when anti-freezing agents are not required. However, known metal corrosion inhibitors have the disadvantage that those employed in combination with anti-freezing agents in winter cannot be employed in summer and those employed in summer cannot be employed in combination with anti-freezing agents in winter. For instance, borax which is a metal corrosion inhibitor employed in combination with anti-freezing agents in winter has difficulty in preparation, because of low solubility in water, and also cannot be employed in summer as a metal corrosion inhibitor, because of insufficient anti-corrosive property in water. Also, chromates employed in summer as a metal corrosion inhibitor cannot be employed in combination with anti-freezing agent in winter, because they accelerate the oxidation of anti-freezing agents.

For these reasons, a metal corrosion inhibitor which can be employed through all seasons is strongly desired in practical and economical sides.

The object of the present invention is to provide a metal corrosion inhibitor which is applicable to various metals employed in cooling systems of internal-combustion engines and is usable for a long term without lowering the excellent anti-corrosive property.

A further object of the invention is to provide a metal corrosion inhibitor which can be diluted with an aqueous liquor and can be employed in combination with a usual anti-freezing agent.

The present invention provides a metal corrosion inhibitor comprising per 100 parts by weight of (a) benzoic acid and/or a benzoate (calculated as benzoic acid), 1.3 to 20 parts by weight of (b) nitrous acid and/or a nitrite (calculated as nitrous acid), 3.8 to 120 parts by weight of (c) phosphoric acid and/or a phosphate (calculated as phosphoric acid), and 1 to 20 parts by weight of (d) at least one member selected from mercaptobenzothiazole, its salts, benzotriazole and tolyltriazole (the amount of the salts of mercaptobenzothiazole being calculated as mercaptobenzothiazole).

Examples of the benzoate employed in the present invention are sodium benzoate and potassium benzoate. Benzoic acid and benzoates may be employed singly or in admixture thereof. Examples of the nitrite employed in the present invention are sodium nitrite and potassium nitrite. Nitrous acid and nitrites may be employed singly or in admixture thereof. Examples of the phosphate employed in the present invention are sodium dihydrogenphosphate, disodium hydrogenphosphate, trisodium phosphate, potassium dihydrogenphosphate, dipotassium hydrogenphosphate and tripotassium phosphate. Phosphoric acid and phosphates may be employed singly or in admixture thereof. As the salts of mercaptobenzothiazole, sodium salt and potassium salt are preferably employed in the present invention.

As the amount of the above components (b), (c) and (d) per 100 parts by weight of the component (a) calculated as benzoic acid, 1.3 to 20 parts by weight of the component (b) calculated as nitrous acid, 3.8 to 120 parts by weight of the component (c) calculated as phosphoric acid, and 1 to 20 parts by weight of the component (d) (the amount of the salt of mercaptobenzothiazole being calculated as mercaptobenzothiazole) are respectively employed. When the amount of the component (b) is less than the above range, the anti-corrosive property to steel and cast iron is insufficient, and when the amount is greater than the above range, the anti-corrosive effect to aluminum and cast aluminum of other components is lowered. When the amount of the component (c) is less than the above range, the anti-corrosive property to aluminum and cast aluminum is poor, and when the amount is greater than the above range, the anti-corrosive effect to copper and brass of other components is lowered. When the amount of the component (d) is less than the above range, the anti-corrosive property to copper and brass is poor. The component (d) may be employed in an amount greater than the above range, but is not economical. The anti-corrosive property to solder of the corrosion inhibitor of the invention is produced by the interaction between each component.

The thus obtained metal corrosion inhibitor of the present invention may be employed in the solid form. In that case, the inhibitor is added to a cooling water as it is. The corrosion inhibitor of the invention may also be prepared to a liquid corrosion inhibitor to provide a commercially available product. In that case, the inhibitor is dissolved in an appropriate amount of water or an anti-freezing agent such as ethylene glycol. Although the concentration of the inhibitor at the time of the preparation is not particularly limited, in case of dissolving in water alone or water containing a small amount of an anti-freezing agent, the concentration is usually selected from 30 to 50% by weight, and in case of dissolving in an anti-freezing agent, the concentration is usually selected from 2 to 15% by weight. The thus prepared liquid corrosion inhibitor is employed by adding to a cooling water.

When the metal corrosion inhibitor of the present invention is employed, it is desirable that pH of a cooling water to which the inhibitor of the invention is added falls within the range of 6.5 to 9.5. If the pH is lower than the above range, the anti-corrosive property to steel and cast iron is decreased. On the other hand, if the pH is higher than the above range, the anti-corrosive property to aluminum and cast aluminum is decreased. In order to maintain the pH of the cooling water within the above range, an appropriate basic material may also be added to the cooling water to which the inhibitor of the invention is added. Examples of the basic material are alkali metal compounds such as sodium hydroxide and potassium hydroxide, amines such as diisopropylamine, morpholine, pyridine, monoethanolamine, diethanolamine and ethylenediamine, and quaternary ammonium salts such as tetraethylammonium hydroxide.

The amount of the corrosion inhibitor of the invention added to a cooling water varies depending on the kind of the metals. In general, the corrosion inhibitor is employed so that the concentration of the inhibitor in a cooling water falls within the range of 6,000 to 70,000 p.p.m. When 3,000 to 50,000 p.p.m. of the component (a) calculated as benzoic acid, 100 to 3,600 p.p.m. of the component (b) calculated as nitrous acid, 300 to 18,000 p.p.m. of the component (c) calculated as phosphoric acid and 50 to 5,000 p.p.m. of the component (d) are present in a cooling water, the excellent anti-corrosive effect can be sufficiently exhibited.

The metal corrosion inhibitor of the present invention is applicable to various metals employed in cooling systems such as aluminum, cast aluminum, cast iron, steel, brass, copper and solder, and can exhibit the excellent anti-corrosive effect for a long term. Also, the corrosion inhibitor of the invention can be employed in combination with anti-freezing agents such as ethylene glycol irrespective of season. Therefore, the corrosion inhibitor of the invention can be employed not only to prevent the corrosion of the cooling systems of internal-combustion engines, but also to prevent the corrosion of the cooling systems in chemical factories and thermoelectric power plants. It is also possible to prevent rust by immersing a metal in an aqueous solution of the corrosion inhibitor of the invention.

The present invention is more particularly described and explained by means of the following Examples, in which all % are by weight unless otherwise noted.

Also, values of weight change described in Examples and Comparative Examples are average values on 3 tests.

EXAMPLE 1

A corrosive water containing 100 p.p.m. of chlorine ion, 100 p.p.m. of sulfate ion and 100 p.p.m. of bicarbonate ion was prepared by adding NaCl, $Na_2SO_4$ and $NaHCO_3$ to distilled water.

Testing solutions Nos. 1 to 4 were then prepared by adding the metal corrosion inhibitor of the present invention to the corrosive water. The concentrations of the components (a), (b), (c) and (d) in each testing solution are shown in Table 1. The testing solutions were adjusted to pH 6.5 to 9.5 by adding sodium hydroxide thereto.

According to the metal corrosion testing method provided in JIS K 2234-1975, cast aluminum, cast iron, steel, brass, solder and copper were used as test specimens, and were assembled and immersed in the testing solutions, and continuous test was carried out at a temperature of 88°±2° C. for 336 hours (14 days) by blowing dry air into the testing solutions to bubble at a rate of about 100±10 ml./minute.

The degree of corrosion of metals was evaluated by weight change of the test specimen according to the following equation.

$$C=(W'-W)/S$$

C: Weight change of the test specimen (mg./cm.$^2$)

W: Weight of the test specimen before immersion (mg.)

W': Weight of the test specimen after immersion (mg.)

S: Total suface area of the original test specimen (cm.$^2$)

The results of the test are shown in Table 2 together with the results of blank test using the corrosive water containing no corrosion inhibitor.

Comparative Example 1

The procedure of Example 1 was repeated except that a testing solution containing the components (a), (b), (c) and (d) in less concentrations as shown in Table 1.

The results are also shown in Table 2.

TABLE 1

| Composition | Example 1 No. 1 | No. 2 | No. 3 | No. 4 p.p.m. | Comparative Example 1 | Blank |
|---|---|---|---|---|---|---|
| Benzoic acid | 4,100 | — | — | — | — | 0 |
| Sodium benzoate | — | — | 15,000 | — | 3,000 | 0 |
| Potassium benzoate | — | 9,000 | — | 50,000 | — | 0 |
| Nitrous acid | — | — | — | 1,600 | — | 0 |
| Sodium nitrite | — | 800 | 800 | — | — | 0 |
| Potassium nitrite | 500 | — | — | — | 100 | 0 |
| Phosphoric acid | — | 2,000 | — | — | 800 | 0 |
| Trisodium phosphate | 1,200 | — | — | — | — | 0 |
| Sodium dihydrogenphosphate | — | — | 1,800 | — | — | 0 |
| Disodium hydrogenphosphate | — | — | — | 15,000 | — | 0 |
| Mercaptobenzothiazole | — | 50 | — | — | 20 | 0 |
| Sodium salt of mercaptobenzothiazole | — | — | 100 | — | — | 0 |
| Potassium salt of mercaptobenzothiazole | 500 | — | — | — | — | 0 |
| Benzotriazole | — | 100 | 200 | 3,000 | 10 | 0 |
| Tolyltriazole | — | 300 | — | — | — | 0 |
| Total | 6,300 | 12,250 | 17,900 | 69,600 | 4,930 | 0 |

TABLE 2

| Metal | Allowable value according to JIS K 2234-1975 | Example 1 No. 1 | No. 2 | No. 3 mg./cm.$^2$ | No. 4 | Comparative Example 1 | Blank |
|---|---|---|---|---|---|---|---|
| Copper | ±0.30 | −0.13 | −0.06 | −0.02 | 0.02 | −0.50 | −0.10 |
| Solder | ±0.60 | −0.07 | −0.02 | −0.03 | −0.02 | −0.07 | −7.07 |
| Brass | ±0.30 | −0.16 | −0.07 | −0.04 | −0.01 | −0.43 | −0.24 |
| Steel | ±0.30 | −0.13 | −0.04 | +0.01 | 0.00 | −0.50 | −9.30 |
| Cast iron | ±0.60 | −0.10 | −0.05 | +0.03 | 0.00 | −1.31 | −11.39 |
| Cast aluminum | ±0.60 | −0.14 | −0.05 | −0.02 | −0.01 | −1.08 | −7.78 |

(Note)
In Table, "−" shows that weight decreased by corrosion, and "+" shows that a corrosion product adhered to test specimen to a degree not removable by a slight treatment and weight increased.

Comparative Example 2

Testing solutions were prepared by respectively adding a commercially available metal corrosion inhibitor A containing mainly phosphoric acid and a commercially available metal corrosion inhibitor B containing mainly nitrous acid to the same corrosive water as in Example 1 in concentration of 3 v./v. % which was optimum concentration of the inhibitors A and B. The corrosion test was carried out in the same manner as in Example 1.

The results are shown in Table 3 together with the results in Example 1, No. 3.

The corrosion inhibitor A is inferior in anti-corrosive property to cast aluminum, and the corrosion inhibitor B is inferior in anti-corrosive property to solder and cast aluminum. In contrast, the corrosion inhibitor of the present invention has a sufficient anti-corrosive property to all of copper, solder, brass, steel, cast iron and cast aluminum.

TABLE 3

| Metal | Example 1 No. 3 | Comparative Example 2 Inhibitor A mg./cm.$^2$ | Inhibitor B |
|---|---|---|---|
| Copper | −0.01 | −0.05 | −0.06 |
| Solder | −0.03 | −0.08 | −3.16 |
| Brass | −0.04 | −0.04 | −0.02 |
| Steel | +0.01 | −0.01 | −0.02 |
| Cast iron | +0.03 | +0.20 | −0.06 |
| Cast aluminum | −0.02 | −0.76 | −1.10 |

EXAMPLE 2

Sodium benzoate, sodium nitrite, sodium phosphate, benzotriazole and mercaptobenzothiazole were dissolved in ethylene glycol which was an anti-freezing agent to give an anti-freezing agent containing 5.8% of sodium benzoate calculated as benzoic acid, 0.16% of sodium nitrite calculated as nitrous acid, 0.76% of sodium phosphate calculated as phosphoric acid, 0.17% of benzotriazole and 0.03% of mercaptobenzothiazole.

The thus prepared anti-freezing agent containing the metal corrosion inhibitor was then dissolved in the same corrosive water as in Example 1 to give a testing solution containing 30 v./v. % of the anti-freezing agent. Each component of the metal corrosion inhibitor was present in the testing solution in concentrations of 20,000 p.p.m. of sodium benzoate calculated as benzoic acid, 550 p.p.m. of sodium nitrite calculated as nitrous acid, 2,600 p.p.m. of sodium phosphate calculated as phosphoric acid, 590 p.p.m. of benzotriazole and 100 p.p.m. of mercaptobenzothiazole. After adjusting the testing solution to pH 6.5 to 9.5 by employing sodium hydroxide, the metal corrosion test was carried out in the same manner as in Example 1 except that the period of test was set to 14 days, 90 days and 180 days.

The results of the tests for 14 days, 90 days and 180 days are shown in Table 4.

As is clear from Table 4, the metal corrosion inhibitor of the present invention can exhibit the excellent anti-corrosive effect for a long term, and the effect is stable even if the inhibitor is employed in combination with ethylene glycol which is an anti-freezing agent.

Comparative Example 3

A commercially available anti-freezing corrosion inhibitor C containing mainly sodium benzoate and a commercially available anti-freezing corrosion inhibitor D containing mainly triethanolamine salt with phosphoric acid, employed for cooling water of internal-combustion engines and guaranteed to be usable for a relatively long term, were added to the same corrosive water as in Example 1 to give testing solutions containing 30 v./v. % of the inhibitor, respectively. The corrosion test was carried out in the same manner as in Example 2.

The results of the tests for 14 days, 90 days and 180 days are shown in Table 4.

The metal corrosion test for 14 days was also carried out by employing ethylene glycol alone. The results are also shown in Table 4.

As is clear from Table 4, when the test is conducted for 90 days, the anti-corrosive property of the inhibitor D lowers, and when the test is conducted for 180 days, the anti-corrosive property of the inhibitor C lowers.

TABLE 4

| | Test for 14 days | | | | Test for 90 days | | | Test for 180 days | |
|---|---|---|---|---|---|---|---|---|---|
| | | Com. Ex. 3 | | | | Com. Ex. 3 | | | Com. Ex. 3 |
| Metal | Example 2 | Inhibitor C mg./cm.$^2$ | Inhibitor D mg./cm.$^2$ | Ethylene glycol | Example 2 | Inhibitor C mg./cm.$^2$ | Inhibitor D mg./cm.$^2$ | Example 2 mg./cm$^2$ | Inhibitor C mg./cm$^2$ |
| Copper | −0.05 | −0.06 | −0.01 | 0.00 | −0.09 | −0.25 | −0.20 | −0.12 | −1.71 |
| Solder | −0.06 | −0.02 | 0.00 | −11.32 | −0.06 | −0.08 | −0.22 | −0.05 | −0.14 |
| Brass | −0.04 | −0.05 | +0.02 | −0.32 | −0.08 | −0.25 | −0.14 | −0.04 | −1.58 |
| Steel | 0.00 | −0.08 | +0.03 | −14.21 | −0.10 | −0.24 | −0.38 | −0.18 | −0.27 |
| Cast iron | 0.00 | +0.03 | +0.38 | −15.21 | −0.08 | −0.02 | −0.09 | −0.04 | −0.22 |
| Cast aluminum | −0.04 | 0.00 | −0.20 | −0.65 | +0.10 | −0.01 | −0.43 | 0.00 | −0.03 |

What we claim is:

1. A metal corrosion inhibitor consisting essentially of per 100 parts by weight of a compound (a) selected from the group consisting of benzoic acid, sodium benzoate, and potassium benzoate, 1.3 to 20 parts by weight of a compound (b) selected from the group consisting of nitrous acid, sodium nitrite and potassium nitrite, 3.8 to 120 parts by weight of a compound (c) selected from the group consisting of phosphoric acid, sodium dihydrogenphosphate, disodium hydrogenphosphate, trisodium phosphate, potassium dihydrogenphosphate, dipotassium hydrogenphosphate and tripotassium phosphate, and 1 to 20 parts by weight of a compound (d) selected from the group consisting of mercaptobenzothiazole, its salts, benzotriazole and tolyltriazole, the amount of sodium benzoate and potassium benzoate being calculated as benzoic acid, the amount of sodium nitrite and potassium nitriate being calculated as nitrous acid, the amount of sodium dihydrogenphosphate, disodium hydrogenphosphate, trisodium phosphate, potassium dihydrogenphosphate, dipotassium hydrogenphosphate and tripotassium phosphate being calculated as phosphoric acid, and the amount of mercaptobenzothiazole salts being calculated as mercaptobenzothiazole.

2. The metal corrosion inhibitor of claim 1, wherein the metal corrosion inhibitor is contained in concentration of 6,000 to 70,000 p.p.m. in water or water containing an anti-freezing agent.

3. The metal corrosion inhibitor of claim 2, wherein said water or water containing an anti-freezing agent is maintained at pH 6.5 to 9.5.

* * * * *